US006474642B1

(12) United States Patent
Dyson

(10) Patent No.: US 6,474,642 B1
(45) Date of Patent: Nov. 5, 2002

(54) BOARD GAME AND METHOD OF PLAYING THE SAME

(76) Inventor: Paul Dyson, 8 Uxbridge Street, Ashton-Under-Lyne Lancashire OL6 7EN (GB)

( * ) Notice: Subject to any disclaimer, the term of this patent is extended or adjusted under 35 U.S.C. 154(b) by 0 days.

(21) Appl. No.: 09/822,076

(22) Filed: Mar. 30, 2001

(51) Int. Cl.[7] ..... A63F 3/00
(52) U.S. Cl. ..... 273/242; 273/267
(58) Field of Search ..... 273/236, 242, 273/243, 267, 287, 275

(56) References Cited

U.S. PATENT DOCUMENTS

| | | | | | |
|---|---|---|---|---|---|
| 1,871,247 | A | * | 8/1932 | Trost | 273/271 |
| 2,253,787 | A | * | 8/1941 | Kelly | 273/142 R |
| 3,638,947 | A | | 2/1972 | Hardesty | |
| 4,035,932 | A | * | 7/1977 | Massey | 273/249 |
| D282,085 | S | | 1/1986 | Hensley | |
| 4,739,992 | A | | 4/1988 | May | |
| 4,801,147 | A | * | 1/1989 | Miller | 273/236 |
| 5,026,068 | A | | 6/1991 | Weisser | |
| 5,029,871 | A | * | 7/1991 | Willson et al. | 273/269 |
| 5,054,788 | A | * | 10/1991 | Kirby | 273/272 |
| 5,236,193 | A | * | 8/1993 | Ierulli | 273/250 |
| 5,377,992 | A | * | 1/1995 | Audet | 273/269 |
| 5,507,495 | A | * | 4/1996 | Kiss | 273/243 |
| 5,524,897 | A | | 6/1996 | Mastronunzio | |
| 5,772,209 | A | * | 6/1998 | Thompson | 273/268 |
| 5,839,729 | A | | 11/1998 | Watanabe | |
| 5,927,717 | A | * | 7/1999 | Berkovi et al. | 273/271 |

* cited by examiner

*Primary Examiner*—Benjamin H. Layno
*Assistant Examiner*—Vishu K Mendiratta

(57) ABSTRACT

A board game and method of playing the same for teaching strategy and providing entertainment. The board game and method of playing the same includes a game board having a top surface has game play space thereon. The game play space is divided into a plurality of triangles radially extending outwardly from a central portion of the game board such that the each of the triangles has an apex positioned generally adjacent to the central portion. The triangle is divided into four rows such that a first through fourth consecutive row is defined. The fourth row is generally adjacent to the central point. Each of the rows is subdivided into a plurality of game spaces. A plurality of game pieces is used for positioning on the game spaces. Each card of a first deck of cards has an action indicia thereon. Each card of a second deck of cards has an action indicia thereon. Each of the players playing chooses a triangle. The players take turns drawing one of the second deck cards and performing the action indicia thereon. The player who draws a second deck card having action indicia thereon indicating winning the game and fills all of the game spaces with a game space wins the game.

6 Claims, 3 Drawing Sheets

BOARD GAME AND METHOD OF PLAYING THE SAME

BACKGROUND OF THE INVENTION

1. Field of the Invention

The present invention relates to board games and more particularly pertains to a new board game and method of playing the same for teaching strategy and providing entertainment.

2. Description of the Prior Art

The use of board games is known in the prior art. More specifically, board games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,026,068; 4,739,992; 5,524,897; 5,839,729; 3,638,947; and U.S. Des. Pat. No. 282,085.

While these devices fulfill their respective, particular objectives and requirements, the aforementioned patents do not disclose a new board game and method of playing the same. The inventive device includes a game board having a top surface has game play space thereon. The game play space is divided into a plurality of triangles radially extending outwardly from a central portion of the game board such that the each of the triangles has an apex positioned generally adjacent to the central portion. The triangle is divided into four rows such that a first through fourth consecutive row is defined. The fourth row is generally adjacent to the central point. Each of the rows is subdivided into a plurality of game spaces. A plurality of game pieces is used for positioning on the game spaces. Each card of a first deck of cards has an action indicia thereon. Each card of a second deck of cards has an action indicia thereon. Each of the players playing chooses a triangle. The players take turns drawing one of the second deck cards and performing the action indicia thereon. The player who draws a second deck card having action indicia thereon indicating winning the game and fills all of the game spaces with a game space wins the game.

In these respects, the board game and method of playing the same according to the present invention substantially departs from the conventional concepts and designs of the prior art, and in so doing provides an apparatus primarily developed for the purpose of teaching strategy and providing entertainment.

SUMMARY OF THE INVENTION

In view of the foregoing disadvantages inherent in the known types of board games now present in the prior art, the present invention provides a new board game and method of playing the same construction wherein the same can be utilized for teaching strategy and providing entertainment.

The general purpose of the present invention, which will be described subsequently in greater detail, is to provide a new board game and method of playing the same apparatus and method which has many of the advantages of the board games mentioned heretofore and many novel features that result in a new board game and method of playing the same which is not anticipated, rendered obvious, suggested, or even implied by any of the prior art board games, either alone or in any combination thereof.

To attain this, the present invention generally comprises a game board having a top surface has game play space thereon. The game play space is divided into a plurality of triangles radially extending outwardly from a central portion of the game board such that the each of the triangles has an apex positioned generally adjacent to the central portion. The triangle is divided into four rows such that a first through fourth consecutive row is defined. The fourth row is generally adjacent to the central point. Each of the rows is subdivided into a plurality of game spaces. A plurality of game pieces is used for positioning on the game spaces. Each card of a first deck of cards has an action indicia thereon. Each card of a second deck of cards has an action indicia thereon. Each of the players playing chooses a triangle. The players take turns drawing one of the second deck cards and performing the action indicia thereon. The player who draws a second deck card having action indicia thereon indicating winning the game and fills all of the game spaces with a game space wins the game.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new board game and method of playing the same apparatus and method which has many of the advantages of the board games mentioned heretofore and many novel features that result in a new board game and method of playing the same which is not anticipated, rendered obvious, suggested, or even implied by any of the prior art board games, either alone or in any combination thereof.

It is another object of the present invention to provide a new board game and method of playing the same which may be easily and efficiently manufactured and marketed.

It is a further object of the present invention to provide a new board game and method of playing the same which is of a durable and reliable construction.

An even further object of the present invention is to provide a new board game and method of playing the same which is susceptible of a low cost of manufacture with regard to both materials and labor, and which accordingly is then susceptible of low prices of sale to the consuming public, thereby making such board game and method of playing the same economically available to the buying public.

Still yet another object of the present invention is to provide a new board game and method of playing the same which provides in the apparatuses and methods of the prior art some of the advantages thereof, while simultaneously overcoming some of the disadvantages normally associated therewith.

Still another object of the present invention is to provide a new board game and method of playing the same for teaching strategy and providing entertainment.

Yet another object of the present invention is to provide a new board game and method of playing the same which includes a game board having a top surface has game play space thereon. The game play space is divided into a plurality of triangles radially extending outwardly from a central portion of the game board such that the each of the triangles has an apex positioned generally adjacent to the central portion. The triangle is divided into four rows such that a first through fourth consecutive row is defined. The fourth row is generally adjacent to the central point. Each of the rows is subdivided into a plurality of game spaces. A plurality of game pieces is used for positioning on the game spaces. Each card of a first deck of cards has an action indicia thereon. Each card of a second deck of cards has an-action indicia thereon. Each of the players playing chooses a triangle. The players take turns drawing one of the second deck cards and performing the action indicia thereon. The player who draws a second deck card having action indicia thereon indicating winning the game and fills all of the game spaces with a game space wins the game.

Still yet another object of the present invention is to provide a new board game and method of playing the same that teaches players strategy by allowing them to keep certain cards in their hand for play during a later turn.

Even still another object of the present invention is to provide a new board game and method of playing the same that has relatively simple rules for allowing competing play between different age groups.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
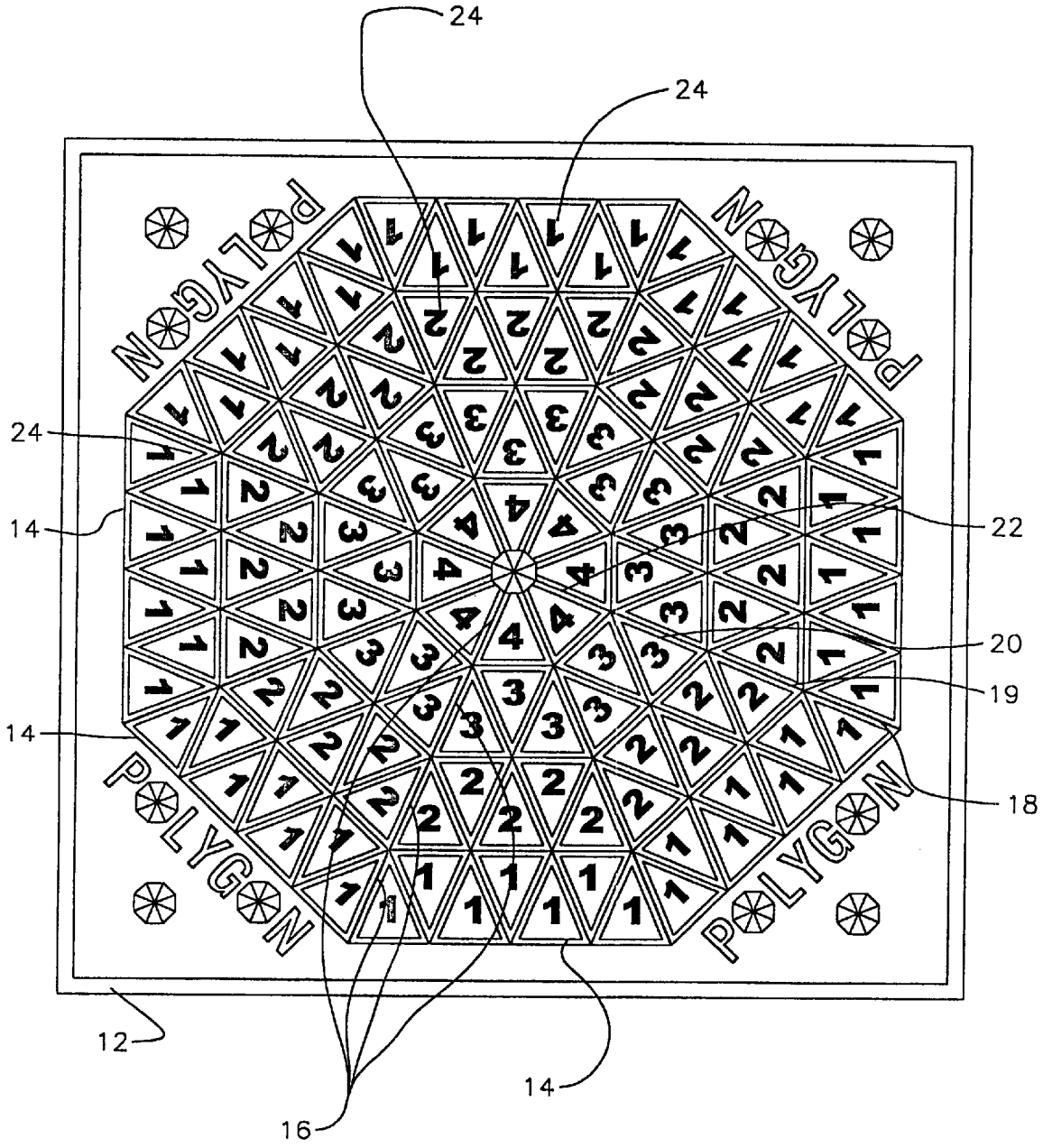
FIG. 1 is a schematic plan view of the game board of a new board game and method of playing the same according to the present invention.
Figure 2:
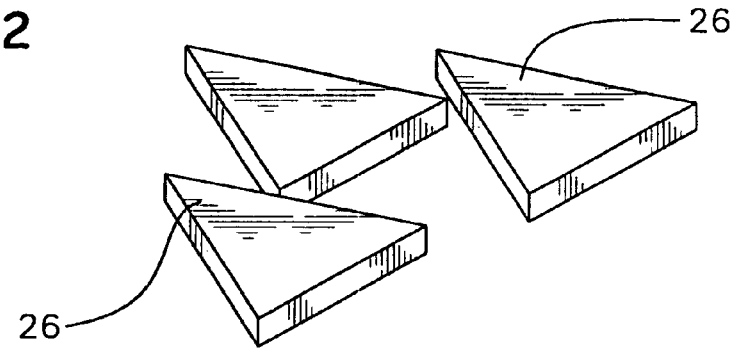
FIG. 2 is a schematic perspective view of the game pieces of the present invention.
Figure 3:
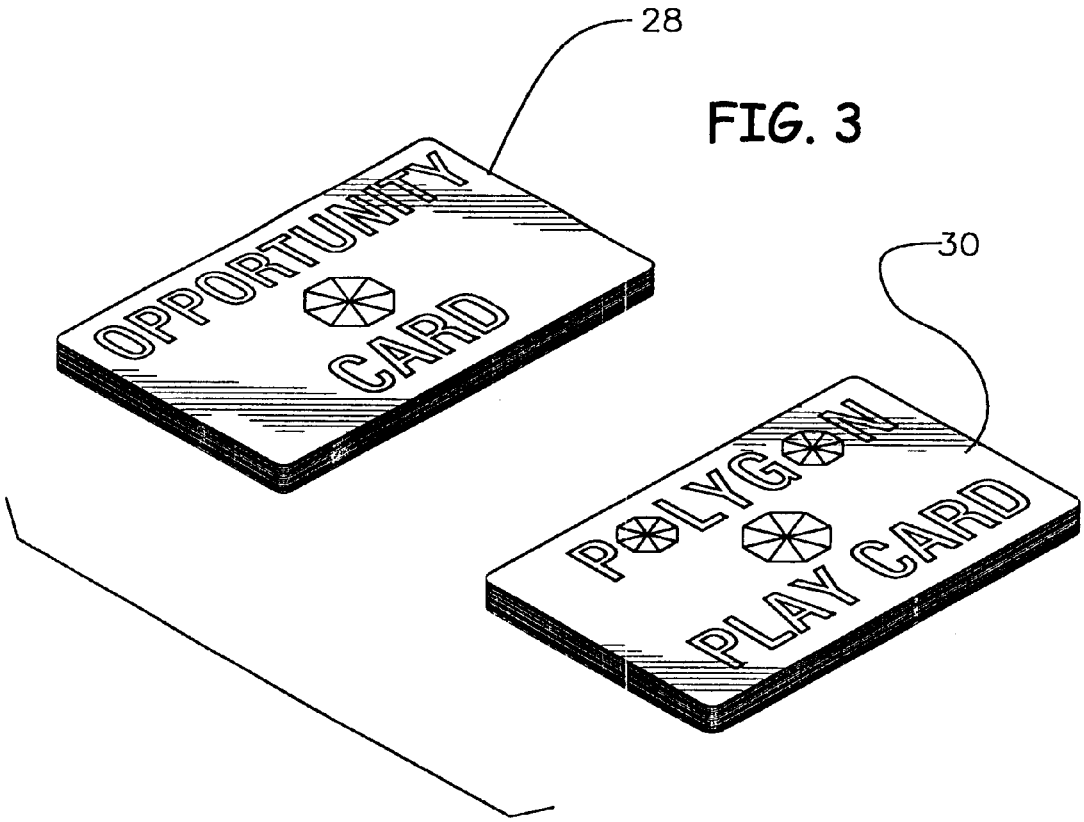
FIG. 3 is a schematic perspective view of the game cards of the present invention.
Figure 4:
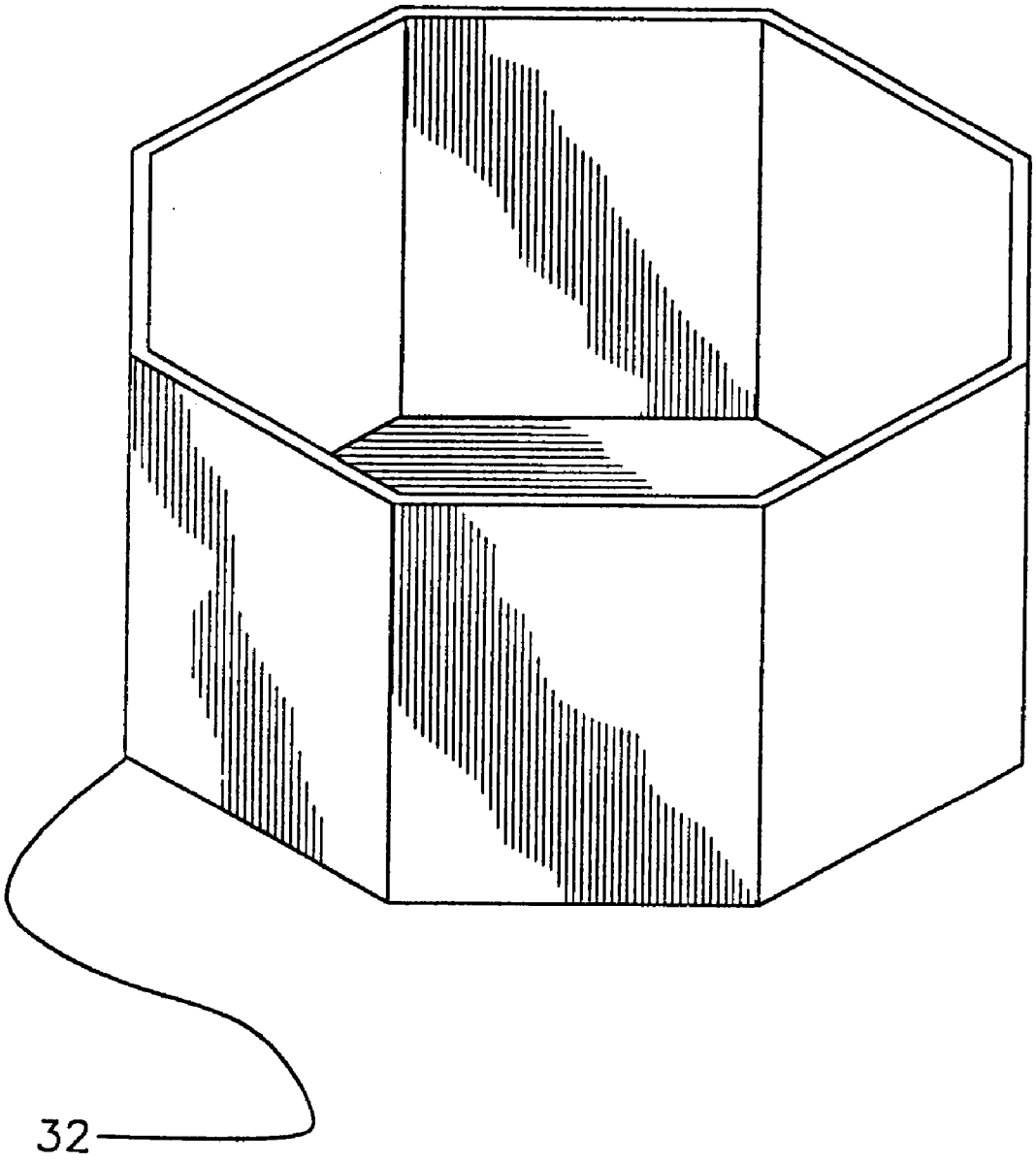
FIG. 4 is a schematic perspective view of the game piece container of the present invention.

With reference now to the drawings, and in particular to FIGS. 1 through 4 thereof, a new board game and method of playing the same embodying the principles and concepts of the present invention and generally designated by the reference numeral 10 will be described.

Parts of the Game

A game board 12 has a top surface having game play space thereon. The game play space is divided into a plurality of triangles 14 radially extending outwardly from a central portion of the game board 12 such that the each of the triangles has an apex positioned generally adjacent to the central portion. The plurality of triangles 14 is ideally eight triangles so that an octagon is formed. Each of the triangles 14 is divided into four rows 16 such that a first 18 through fourth 22 consecutive row is defined. The fourth row 22 is generally adjacent to the central point. Each of the rows 16 is orientated generally parallel with a respective base of the triangle 14. Each of the rows 16 is subdivided into a plurality of game spaces 24. Each of the game spaces 24 preferably has a triangular shape and they are interspersed with each other such that upside down game spaces are adjacent to upright game spaces. Each of the game spaces 24 preferably has a number indicia therein corresponding to the row 16 the space is in. Ideally, the first row 18 has seven game spaces therein, the second row 19 has five game spaces therein, the third row 20 has three game spaces therein, and the fourth row 22 has one game space 24 therein. Each of the game spaces 24 is colored a color selected from the group consisting of red, yellow, blue and green. The colors are generally random though ideally no two triangles having the same color should have an abutting edge.

A plurality of game pieces 26 is used for positioning on the game spaces 24. Each of the game pieces 26 is ideally colored a color selected from the group consisting of red, yellow, blue and green. Each of the game pieces 26 has a generally triangular shaped top surface.

Each card of a first deck of cards 28 has an action indicia thereon. The action indicia is ideally chosen from the group consisting of lose cards, snatch a card, add any game piece, lose a game piece, snatch a game piece and remove a game piece. The cards of the first deck of cards are divided as follows:

9 snatch a card;

9 snatch a game piece;

9 remove a game piece;

9 lose a game piece;

9 lose cares;

9 add any counter;

Each card of a second deck of cards 30 also has action indicia thereon. The action indicia is ideally taken from the group consisting of adding a game piece, drawing a card from the first deck of cards, adding any numbers game piece to any game space, grabbing a card, nullify a card and winning the game. Each of the cards having adding a game piece indicia thereon has a number indicia thereon relating to one of the rows and is colored a color selected from the group consisting of red, yellow, blue and green. Each of the cards having adding any numbered game piece is colored a color selected from the group consisting of red, yellow, blue and green. The cards of the second deck are divided as follows:

28 add a (1) game piece;

20 add a (2) game piece;

12 add a (3) game piece;

4 add a (4) game piece;

12 any game piece.

The add any game piece cards are each colored as described above such that there are an equal number of each color. For example, there are 7 red, 7 blue, 7 green and 7 yellow add a (1) game piece cards.

5 grab a card;

5 nullify a card;

3 winning the game;

15 drawing a card from the first deck.

Preferably, a container 32, having an octagon shape, is included for holding all of the game pieces.

Rules of the Game

The primary object is to fill each of the game spaces 24 with a game piece 26. The players must fill the rows 16 in consecutive fashion so that if the first 18 and second 19 rows are filled and the player looses a game piece from the first row 18, all of the game pieces 26 from the second row 19 must be removed. Each of the game pieces 26 is colored to match the game spaces 24. The game piece 26 chosen from the container 32 must have a color that matches the game space 24 is it placed in.

Each of the players chooses a triangle to fill with game pieces.

The first player draws one of the second deck cards. Turns are then taken clockwise about the game board. After drawing the card from the second deck, a plurality of options are available to the player, including:

1. Discarding the card drawn if the player chooses not to keep the card. This is placed in a discard pile generally positioned adjacent to the second deck of cards. If all of the cards from the second deck are in the discard pile or in player's hands, the discard pile is reshuffled.

2. The player may keep the card for use in a later turn. The player may not keep more than three of the second deck cards at any one time. The card kept are hidden from other players.

3. The player may place a game piece on a corresponding numbered and colored game space if the second deck card drawn has indicia indicating adding a game piece thereon. A player must fill the game spaces with the game pieces in the first through fourth rows in consecutive order such that the game spaces in the first row is filled before game spaces in the second row are filled with the game pieces. For example, if a player draws a card colored red and having a number 3 on it, the player may only fill in a red row 3 game space if one if available and rows 1 and 2 are filled.

4. The player may place a game piece in one of the game spaces corresponding to the color indicated on the card if the second deck card drawn has indicia indicating adding any numbered game piece to any game space. In the case of this card, it does not matter what row the game piece is placed in, only that the color on the card matches the color in game space.

5. The player may take a top card off of the discard pile of the second deck cards if the second deck card drawn has indicia indicating grabbing a card.

6. The player may reverse the action indicia of the previous card played if the second deck card drawn has indicia indicating nullify. The player may not play the nullify card when another player has played the card has indicia indicating winning the game. This card is generally used to counter a card played by a previous player.

7. A player wins the game if the second deck card has indicia indicating winning the game and if the player has filled all of the game spaces with the game pieces.

8. A player draws a card from the first deck of cards if the second deck card has indicia thereon indicating drawing a card from the first deck of cards. Unlike the other cards drawn, when a player draws this card, the player must draw a card from the first deck of cards and may not keep that card for later use. A card being kept may be played at the beginning of any turn. The first deck of cards also has action indicia thereon which must be performed when drawn and may not be kept for later play. The results of drawing a card from the first deck are as follow:

a. The player loses all second deck cards being kept by the player if the card drawn has indicia thereon indicating lose cards. The player loosing their cards must discard each card individually such that a player holding a card indicating grab a card may take a discarded card. The player wanting the discarded card must act before the next card is discarded.

b. The player removes one of the kept cards from another player if the card drawn has indicia thereon indicating snatch a card. The player removing the card must first designate which player a card will be removed from. The player may then see the cards that the chosen player is holding to remove that card for playing or for keeping.

c. The player places a game piece on any game space if the card drawn has indicia indicating add any counter. This must be done according to the rules above for adding game pieces.

d. The player removes any game piece of another player off of the game board if the card drawn has indicia indicating snatch a game piece. If a game piece is removed from a filled row then all game pieces will be removed in rows above the filled row in accordance to the rules above for filling rows. The game piece removed must be a game piece needed by the player drawing the card from the second deck. For example, a player may not remove a row 3, yellow game piece if the player removing it does not need a row 3, yellow game piece.

e. The player removes a game piece of the player's own if the card drawn has indicia indicating lose a game piece. The game piece removed is one from the current row being filled.

f. The player removes a game piece of another player's highest row which is being filled at that time if the card drawn has indicia indicating remove a game piece.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a board game, comprising the steps of:

providing a game board, said game board having a top surface having game play space thereon, said game play space being divided into a plurality of triangles radially extending outwardly from a central portion of said game board such that said each of said triangles has an apex positioned generally adjacent to said central portion, each of said triangles being divided into four rows such that a first through fourth consecutive row is defined, said fourth row being generally adjacent to said central point, each of said rows being subdivided into a plurality of game spaces;

providing a plurality of game pieces for positioning on said game spaces;

providing a first deck of cards, each of said first deck of cards having an action indicia thereon;

providing a second deck of cards, each of said second deck of cards having action indicia thereon;

providing a plurality of players;

each of said players choosing a triangle;

drawing one of said second deck cards by a first player and performing said action indicia thereon;

winning the game by drawing a second deck card having action indicia thereon indicating winning the game and filling all of said game spaces with a game piece;

wherein the steps of providing a game board and providing a plurality of game pieces further comprises;

each of said game spaces being colored a color selected from the group consisting of red, yellow, blue and green; and each of said game pieces being colored a color selected from the group consisting of red, yellow, blue and green, each of said game pieces having a generally triangular shaped top surface;

wherein the step of providing a first deck of cards further includes:

said action indicia on said first deck of cards being chosen from the group consisting of lose cards, snatch a card, add any game piece, lose a game piece, snatch a game piece and remove a game piece;

wherein the step of providing a second deck of cards further includes:

said action indicia on said second deck of cards being taken from the group consisting of adding a game piece, drawing a card from said first deck of cards, adding any numbers game piece to any game space, grabbing a card, nullify a card and winning the game, each of said cards having adding a game piece indicia thereon having a number indicia thereon relating to one of said rows and being colored a color selected from the group consisting of red, yellow, blue and green, each of said cards having adding any numbered game piece being colored a color selected from the group consisting of red, yellow, blue and green; and wherein the step of drawing a card further includes the steps of:

discarding said card drawn if said player chooses not to keep said card;

keeping said card for use in a later turn, wherein said player may not keep more than three of said second deck cards, wherein all kept cards are hidden from other players;

placing a game piece on a corresponding numbered and colored game space if said second deck card drawn having indicia indicating adding a game piece thereon, wherein a player must fill said game spaces with said game pieces in said first through fourth rows in consecutive order such that said game spaces in said first row is filled before game spaces in said second row are filled with said game pieces;

placing a game piece in one of said game spaces corresponding to the color indicated on the card if said second deck card drawn having indicia indicating adding any numbered game piece to any game space;

taking a top card off of the discarded second deck cards if said second deck card drawn having indicia indicating grabbing a card;

undoing an action taken in response to the action indicia of the previous card played if said second deck card drawn having indicia indicating nullify, wherein said player may not play the nullify card when anther player has played said card having indicia indicating winning the game; and drawing a card from said first deck of cards if said second deck card having indicia thereon indicating drawing a card from said first deck of cards, wherein said player must draw a card from said first deck of cards during the corresponding turn and may not keep the card.

2. The method of playing a board game as in claim 1, wherein the step of providing a game board further comprises:

each of said game spaces generally having a triangular shape, each of said game spaces in having a number indicia therein corresponding to the row said game space is in, said first row having seven game spaces therein, said second row having five game spaces therein, said third row having three game spaces therein, said fourth row having one game space therein.

3. The method of playing a board game as in claim 1, wherein the step of drawing a card from the first deck of cards further includes the steps of:

losing all second deck cards being kept by said player if said card drawn having indicia thereon indicating lose cards, wherein said player loosing their cards must discard each card individually such that a player having a card indicating grab a card may take a discarded card;

removing one of the kept cards from another player if said card drawn having indicia thereon indicating snatch a card, wherein said player removing the card must first designate which player a card will be removed from;

placing a game piece on any game space if said card drawn having indicia indicating add any counter;

removing any game piece of another player off of said game board if said card drawn having indicia indicating snatch a game piece, wherein if a game piece is removed from a filled row then all game pieces will be removed in rows above the filled row, wherein said game piece removed must be a game piece needed by said player drawing said card from said second deck; and removing a game piece of another player's highest row being filled if said card drawn having indicia indicating remove a game piece.

4. The method of playing a board game as in claim 1, wherein the step of providing a first deck of cards further includes:

said action indicia on said first deck of cards being chosen from the group consisting of lose cards, snatch a card, add any game piece, lose a game piece, snatch a game piece and remove a game piece.

5. The method of playing a board game as in claim 4, wherein the step of providing a second deck of cards further includes:

said second deck of cards having action indicia thereon taken from the group consisting of adding a game piece, drawing a card from said first deck of cards, adding any numbers game piece to any game space, grabbing a card, nullify a card and winning the game.

6. A method of playing a board game, comprising the steps of providing a game board, said game board having a top surface having game play space thereon, said game play space being divided into a plurality of triangles radially extending outwardly from a central portion of said game board such that said each of said triangles has an apex positioned generally adjacent to said central portion, said plurality of triangles being eight triangles, each of said triangles being divided into four rows such that a first through fourth consecutive row is defined, said fourth row being generally adjacent to said central point, each of said rows being orientated generally parallel with a respective base of said triangle, each of said rows being subdivided into a plurality of game spaces, each of said game spaces generally having a triangular shape, each of said game spaces in having a number indicia therein corresponding to the row said space is in, said first row having seven game spaces therein, said second row having five game spaces therein, said third row having three game spaces therein, said fourth row having one game space therein, each of said game spaces being colored a color selected from the group consisting of red, yellow, blue and green;

providing a plurality of game pieces for positioning on said game spaces, each of said game pieces being colored a color selected from the group consisting of red, yellow, blue and green, each of said game pieces having a generally triangular shaped top surface;

providing a first deck of cards, each of said first deck of cards having an action indicia thereon, said action indicia being chosen from the group consisting of lose cards, snatch a card, add any game piece, lose a game piece, snatch a game piece and remove a game piece;

providing a second deck of cards, each of said second deck of cards having action indicia thereon taken from the group consisting of adding a game piece, drawing a card from said first deck of cards, adding any numbers game piece to any game space, grabbing a card, nullify a card and winning the game, each of said cards having adding a game piece indicia thereon having a number indicia thereon relating to one of said rows and being colored a color selected from the group consisting of red, yellow, blue and green, each of said cards having adding any numbered game piece being colored a color selected from the group consisting of red, yellow, blue and green;

providing a plurality of players;

each of said players choosing a triangle;

drawing one of said second deck cards by a first player, wherein the step of drawing one of said second deck cards further comprises the steps of;

discarding said card drawn if said player chooses not to keep said card;

keeping said card for use in a later turn, wherein said player may not keep more than three of said second deck cards, wherein all kept cards are hidden from other players;

placing a game piece on a corresponding numbered and colored game space if said second deck card drawn having indicia indicating adding a game piece thereon, wherein a player must fill said game spaces with said game pieces in said first through fourth rows in consecutive order such that said game spaces in said first row is filled before game spaces in said second row are filled with said game pieces;

placing a game piece in one of said game spaces corresponding to the color indicated on the card if said second deck card drawn having indicia indicating adding any numbered game piece to any game space;

taking a top card off of the discarded second deck cards if said second deck card drawn having indicia indicating grabbing a card;

undoing an action taken in response to the action indicia of the previous card played if said second deck card drawn having indicia indicating nullify, wherein said player may not play the nullify card when anther player has played said card having indicia indicating winning the game;

winning the game if said second deck card having indicia indicating winning the game and if the player has filled all of said game spaces with said game pieces;

drawing a card from said first deck of cards if said second deck card having indicia thereon indicating drawing a card from said first deck of cards, wherein said player must draw a card from said first deck of cards during the corresponding turn and may not keep the card, wherein the step of drawing a card from the first deck of cards further includes the steps of;

losing all second deck cards being kept by said player if said card drawn having indicia thereon indicating lose cards, wherein said player loosing their cards must discard each card individually such that a player having a card indicating grab a card may take a discarded card;

removing one of the kept cards from another player if said card drawn having indicia thereon indicating snatch a card, wherein said player removing the card must first designate which player a card will be removed from;

placing a game piece on any game space if said card drawn having indicia indicating add any counter;

removing any game piece of another player off of said game board if said card drawn having indicia indicating snatch a game piece, wherein if a game piece is removed from a filled row then all game pieces will be removed in rows above the filled row, wherein said game piece removed must be a game piece needed by said player drawing said card from said second deck;

remove a game piece of the player's own if said card drawn having indicia indicating lose a game piece; and removing a game piece of another player's highest row being filled if said card drawn having indicia indicating remove a game piece.

* * * * *